United States Patent [19]

Hagelberg

[11] 4,355,718

[45] Oct. 26, 1982

[54] GRAMMOPHONE RECORD SLEEVE

[75] Inventor: Gabriella Hagelberg, Stockholm, Sweden

[73] Assignee: Bengt Petersson New Products Investment AB, Askim, Sweden

[21] Appl. No.: 187,836

[22] PCT Filed: May 10, 1979

[86] PCT No.: PCT/SE79/00106

§ 371 Date: Jan. 11, 1980

§ 102(e) Date: Jan. 11, 1980

[87] PCT Pub. No.: WO79/01059

PCT Pub. Date: Dec. 13, 1979

[30] Foreign Application Priority Data

May 11, 1978 [SE] Sweden ..... 7805372
Nov. 13, 1978 [JP] Japan ..... 53-139746

[51] Int. Cl.[3] ..... B65D 85/57; B65D 27/20; A44B 17/00; A44B 19/14

[52] U.S. Cl. ..... 206/312; 206/303; 150/3; 24/204; 229/68 R

[58] Field of Search ..... 361/212, 220; 206/313, 206/334, 444, 307, 312, 440, 303; 150/3; 24/204; 229/68 R

[56] References Cited

U.S. PATENT DOCUMENTS

| | | | |
|---|---|---|---|
| 3,062,371 | 11/1962 | Patience | 206/440 |
| 3,127,089 | 3/1964 | Freeman | 206/307 |
| 3,325,084 | 6/1967 | Ausnit | 24/204 |
| 3,462,068 | 8/1969 | Suominen | 150/3 |
| 3,557,413 | 1/1971 | Engle | 24/204 |
| 4,200,189 | 4/1980 | Hagelberg | 206/313 |

*Primary Examiner*—William T. Dixson, Jr.

[57] ABSTRACT

Grammophone record sleeve made of thin material as paper or cardboard and comprising a first section and a second section (13), which sections are connected to each other and intended to store the record (9) in between them and have such a size and shape that they substantially cover the same. The sleeve is made of a material which surface is electrically conducting at least on the substantially part of the surfaces which by the storing of the grammophone record (9) in the sleeve will be in contact with the sides thereof and on at least one surface of contact (8) which is so positioned that it presumably will get in contact with the hand of a person handling the sleeve for the insertion and extraction of the grammophone record whereby said inner surface or surfaces are in electrically leading connection with the surface or surfaces of contact.

7 Claims, 14 Drawing Figures

GRAMMOPHONE RECORD SLEEVE

TECHNICAL FIELD

The present invention relates to aids provided to keep grammophone record free of dust. By playing grammophone records the dust collected on the record causes considerable trouble and disturbances. Modern records of plastics material are charged with static electricity when played and handled, and because thereof they will attract dust. If the dust is not removed, the quality of the sound will be very bad as a result of particles of greater size causing clicks and the finest dust in the grooves of the record produces a distorsion of the sound when the record is played.

More exactly the invention refer to a sleeve for a grammophone record, which reduce the electric charge of the record and thus also its tendency to collect dust.

BACKGROUND ART

A great many auxialiary means have been created in order to remove the dust from the grammophone record before it is played. Thus clothes and brushes exist as well as brushes and pads which are dragging on the record during the playing of the same in order to collect the dust ahead of the stylus. However, these auxiliary means complicate the playing and have but a limited effect with respect to the removal of the finest dust particles from the groove of the record where they are fixed by the electrostatic forces.

However, also methods provided to remove the electrostatic charge exist by means of which the tendency of the record to collect dust is reduced. There are for example charging devices for the charging of the record with a charge opposite to the natural charge of the record so that the dust particles shall be repelled. Such a device is however complicated and will be expensive. The recharging operation also means a special manuvering. An aid in a common use is the diposing of a conducting plate on the turntable, usually called "carbon-plate" as such a plate usually is made of carbon rubber. The intension behind this plate is that the played side of the record will be grounded when this side is turned downwards against the turntable so that the electrostatical charge is removed. However, said plate has a very restricted effect as the grounding of the same usually is very unsufficient and also as a result of that the side of the record which is played latest not will be discharged if this side not is turned down against the carbon-plate by means of a certain operation in order to obtain a discharge. Usually the record is removed from the turntable after that the last side is played which results in that only the one side will be discharged.

The cover grammophone records usually are wrapped in comprises in general an inner sleeve of thin soft paper and together with this sleeve an outer sleeve of stiff cardboard. When a record is to be played it thus first has to be removed from the outer sleeve together with the inner sleeve and subsequently be taken out from the inner sleeve and be placed on the turntable of the recordplayer. As is well known a grammophone record with its fine engraving is easily damaged by scratches and must not be touched with the hands, as grease will then be deposited on the surface. Dust will subsequently be accumulated in the grease and will unfavourably affect the quality of the sound, when the record is played.

When the record is taken out from the inner sleeve, which has the form of a flat bag open at one end, the record thus must be handled in a very uncomfortable manner. The only possible way to take out the record without touching the engraving with the fingers is to introduce the hand into the sleeve without touching the record and place the four fingers against the label and the thumb against the very edge whereafter the record can be taken out while balancing it on the fingertips. After removal of the record sleeve the record has to be taken with both hands by pressing against the peripherical edge on diametrically opposed sides and with this hold deposit the record on the turntable. When putting down the record into the sleeve the operation takes place in inverted order; thus after grasping the record with the fingertips of both hands it has to be caught with the fingertips and the thumb of one hand and subsequently inserted into the sleeve, whereafter the hand has to be withdrawn without touching the record. In connection with these manipulations it is impossible to avoid that the record slides against the walls of the sleeve, which can give rise to scratches. In order to prevent this, the innersleeves are often made of a special soft paper or of paper lined with a plastics layers in order to avoid contamination by particles of fluff from such paper.

DISCLOSURE OF THE INVENTION

TECHNICAL PROBLEM

As evident from the description of the prior art are the means provided to reduce or remove dust collections on grammophone records very little satisfying from the point of handling and effictivity. At the same time can be established that the record sleeve which are used are inconvenient and timeconsuming by handling and they give great risks of diposing of fingerprints on the record in which dust can be collected. Further the surfaces of the record can be charged as a result of friction as it is necessary to move the record out of and into the sleeve.

THE SOLUTION

The basic ideas behind the invention is an eliminating of said disadvantages by means of a record sleeve which is made in that way that the surfaces, which shall be in contact with the sides of the record, are electrically conducting and that said conducting surfaces are in contact with a conducting surface that will be grasped with the hand when the sleeve is handled. By this arrangement the sides of the record are grounded via the conducting surfaces of the body of the person handling the sleeve, so that the electrostatic charge of the record is removed. If the record is placed in the sleeve immediately after it has been played, the discharge takes place so soon after the record has been charged with static electricity that the exposition to dust and the resulting dust collection will be of the smallest possible degree. As long as the record is stored in the conducting sleeve, it has not any tendency to accumulate dust. After its removal from the sleeve, the record is discharged and has no tendency to attract particles of dust.

By means of a certain shape of the sleeve which make it possible to entirely open the same by the handling of the record the handling can be faciliated and a friction between the surfaces of the record and the surfaces of the sleeve be avoided.

ADVANTAGES

By means of the invention it is thus obtained that a charge of static electricity at the surfaces of the record is eliminated so that the tendency of dust collecting is reduced. Further an easier handling of the record and its sleeve can be obtained.

BRIEF DESCRIPTION OF DRAWINGS

In the following two main embodiments of a record sleeve according to the invention is described, the first embodiment in four variants, references made to the accompaning drawings. In the drawings

BEST MODE OF CARRYING OUT THE INVENTION

Figure 1:
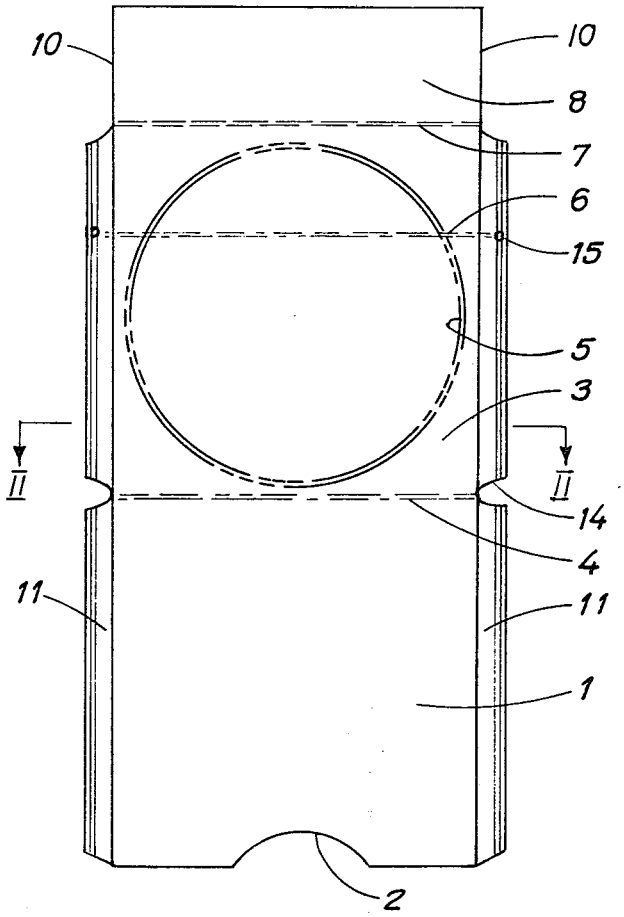
FIG. 1 shows an extension of the first embodiment.

The record sleeve illustrated in FIGS. 1–6 and 7 and 10–14 is made of a sheet of paper, which is folded to form three sections 1, 3 and 8. The section 1 and 3 correspond in size to the outer dimensions of the grammophone record 9 which is intended to be stored in the sleeve and said sections are intended to enclose the record. The section 8 is smaller and intended to form a flap for the holding of the record 9 without touching the same. The paper sheet is lined on one side with a thin aluminum foil. The side provided with the aluminum foil is hinted in FIGS. 2, 3 and 7, which are cross-sections by means of these surfaces are shown corrugated. As evident from the FIG. 7 it is the sides of the sections 1 and 3 facing the record which are provided with aluminum foil 17 and the section 8 is completely covered with aluminum foil. In order to secure that the flap 8 will be coated with aluminum foil on both sides, it is, according to FIG. 7, double folded and the paper is glued at the point indicated 18. (For clarity's sake the glued point 25 is shown slightly folded in upwards direction.)

The three sections 1, 3 and 8 which in the following are called the first section, the middle section and the edge section respective are divided by means of a folding lines 4 and 7. Further is the middle section 3 provided in two sections by means of a folding line. The first section 1 is at its edge provided with a cut 2 and the middle section can be divided with an embossing 5 corresponding to the size of the record. Along the both side edges 10 of the papersheet extend edge stripes 11 which will be described closer in the following. The several variants of the record sleeve according to the first embodiment differs in respect of these edge stripes 11.

The edgestripes 11 can be made so that the sleeve can be locked along the edges 10 when it is folded around a grammophone record. Hereby it is prevented that the record slips out and that dust penetrate into the record. It is possible to use the shown form of the sleeve without any locking possibility and thereby in the first hand if one intend to store the same in a baglike outer sleeve. However, it is most practical if the storing aid not have to be divided in an inner sleeve and an outer sleeve which is possible if such lockable edge stripes 11 which are described in the following are used. By this arrangements the sleeve according to the now described embodiment can form the single storing means for the grammophone record.

Figure 2:
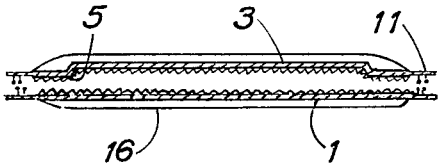
FIG. 2 shows a cross sectional view of the same along the line II—II in FIG. 1.
Figure 3:
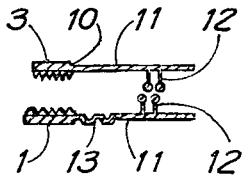
FIG. 3 shows in a cross sectional view in detail the first variant.

The first variant of the lockable edge stripes is shown in FIGS. 2 and 3. The edge stripes 11 are in this connection made of plastic foil which can extend over the entire outer side of the sleeve with a portion 16. The stripes 11 are provided with double rims 12 between which notches are formed. If the stripes 11 are pressed together the rims 12 will work as a locking element with a "zipper-like" snap action. As the rim of the one stripe has to enter the notch between the rims of the other stripe it is necessary to displace the two double rims along the section 1 in relation to the rims along the section 3. This displacements are obtained by providing a corrugation 13 on the stripes 11 along the first section 1. This corrugation can however be omitted if the rims have sufficient bending properties sideways.

In order to faciliate the folding of the different sections to each other the stripes 11 are broken at 14 and 15 in the center of the folding lines 4 and 6 respectively. The described locking elements are of a type known before and are used especially by plastic bags and plastic cases. The lock is easy to close and open by pressing the locking elements together or drawing them apart respectively.

Figure 10:
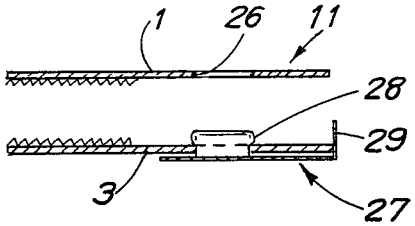
FIGS. 10 and 11 show in cross sectional views the second variant of the first embodiment.
Figure 11:
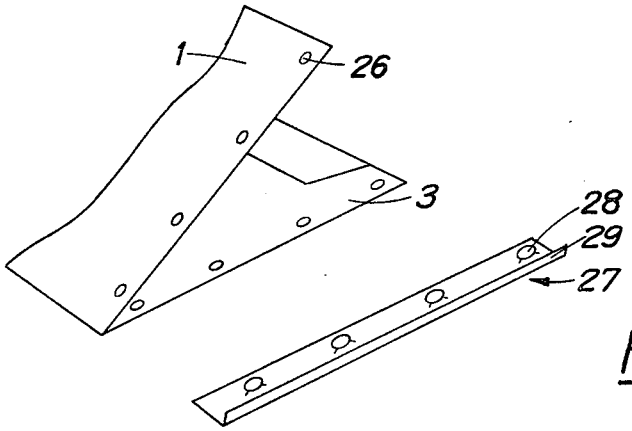
Figure 12:
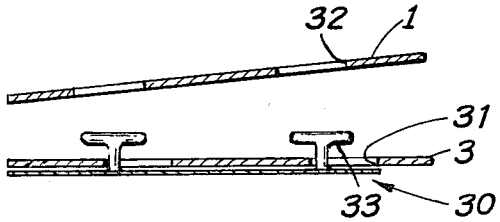
FIGS. 12, 13 show the third variant in two sectional views
Figure 13:
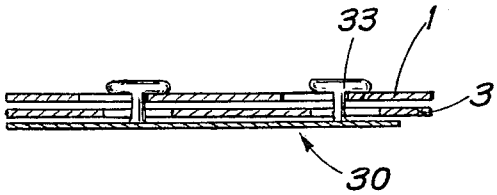

At the variant according to FIGS. 10 and 11 the edge stripes 11 are continuations to the paper material in the sections 1 and 3. Along the paper stripes 11, formed in the said way, are holes 26 punched with the holes in the section 1 in the front of the respective holes in the section 3 when the both sections are folded together. Further there are at each side edge 10 a portion 27 i.e. a slip formed of a thin but ridgid plastic material in which are embossed extensions 28 of a mushroomlike shape. These extensions 28 are sized to be pressed through the holes 26 under a certain resistance. Thus they have to be pressed together by the passing of the holes. By pressing the extensions 28 through the holes of the section 3 as shown in FIG. 10 the slip 27 can be attached to the sleeve. By the locking operation the edges of the holes 26 in the section 1 are pressed on to the extensions 28 and thereby the sections 1 and 3 are locked to each other. The slips 28 are further provided with bended edge portions 29 which will give a sealing against dust along the side edges 10. For the reinforcement of the closing means also the section 1 can be provided with a slip of about the same shape as the slip 27, which slip is attached to the section 1 by means of pressing the extensions 28 of the same through the holes 26. By locking the said both slips can cooperate with each other by means of pressing the extension of the one slip down into the extensions of the second slip. The embodiment shown in FIGS. 12 and 13 are also provided with slips 30 along the side edges 10 which exhibit extending edge portions of the paper material in the sections 1 and 3. These edge portions are provided with elongated slots 31 in the section 3 and slots 32 in the section 1. The slips 30 are provided with T-shaped extending embossings 33. The slots 31 and 32 are in the direction of the edges 10 out of line of each other. This arrangement result in that the slips 30 in the position shown in FIG. 12 are secured to the section 3 by means of the one extending edge of the T-shaped embossing extends out over the edge of the slot 31. On the contrary the embossing 33 is positioned in the front of the slot 32 and the section 1 can thus be folded down over the embossings 33. Thereafter the slips 33 can be displaced (in FIG. 12 toward the right side) resulting in that the edges of the embossings 33 clutch over the edges of the slots 32 and lock the both sections 1 and 3 to each other. When, by the mounting of the slips 33 the embossings 33 of the same have to be pushed through the slots 31 the slips are displaced so the embossings are positioned in the fronts of said slots. By this embodiment a certain displacement manuever is necessary for the opening and locking of the sleeve.

Figure 14:
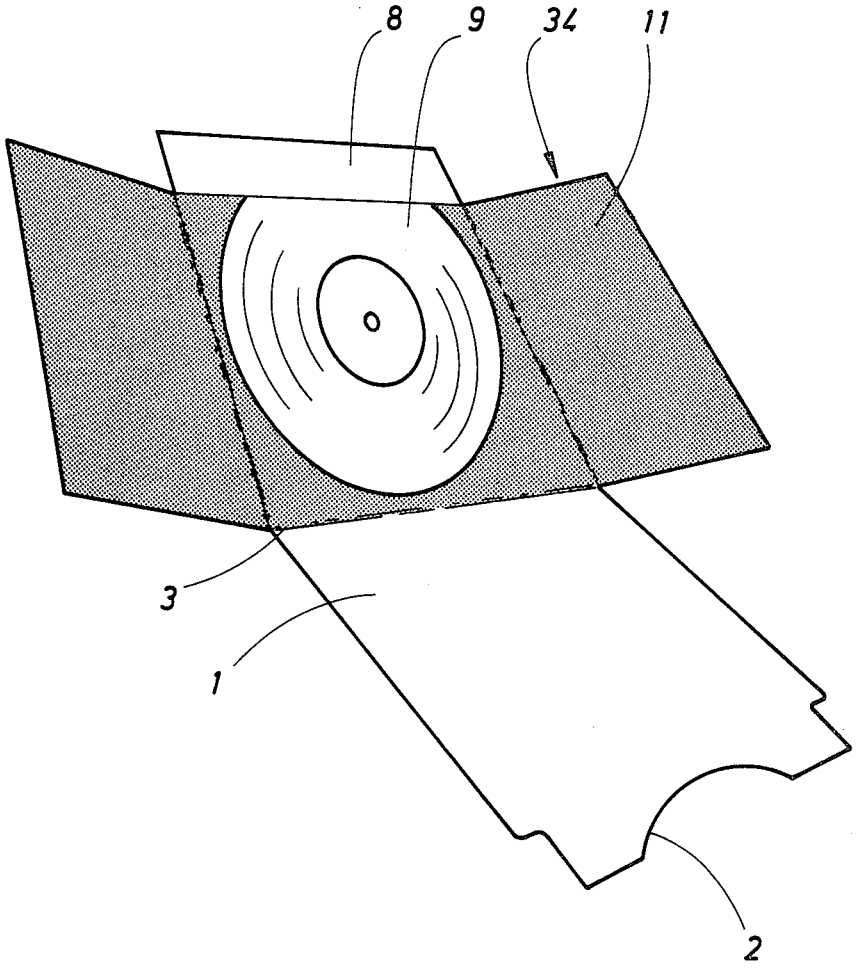
FIG. 14 shows the fourth variant in view.

At the in FIG. 14 shown embodiment the edge section 8 is attached to the middle section 3 along the side edges 10. The aluminum foil coating by this embodiments is formed of a aluminum lined paper sheet 34 the width of which is about equal to the double diameter of the grammophone record 9. At each side of the portion 30 is thus extending edges portions 11 the width of which approximately corresponds to half the diameter of the record. The aluminum foil lining of the paper sheet 34 is directed against the observer of FIG. 14.

At the closing of the sleeve the side portion 11 of the sheet 34 will be folded in over the record and the same will be enclosed in aluminum foil with exclusion of the edge placed inside the edge portion 8. However, also the pocket formed of the edge section 8 and the opposite portion of the middle section 3 can be lined with aluminum foil.

After the folding in of the edge portion 11 formed of the sheet 34 the first section 1 is folded down over the sheet 34 and is pushed inside the edge section 8 and is secured of the same. The first portion 1 thereby secure the edge portions 11.

A certain outer surface to which the aluminum foil of the sheet 34 is connected is not entirely necessary as the aluminum foil lining of the edge portions 11 will be touched when they are folded in and folded out. However, a surface of contact can be provided on the edge section 8.

Figure 4:
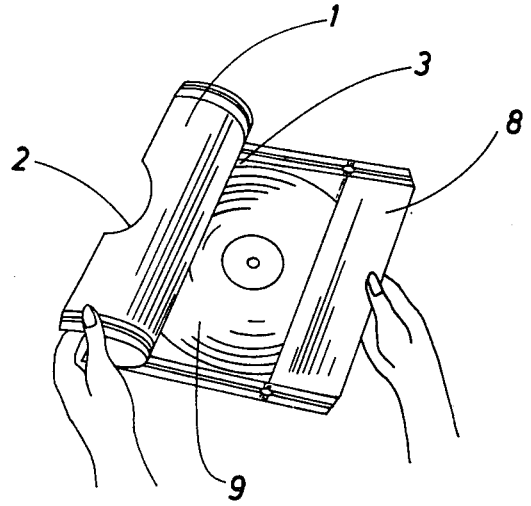
FIGS. 4–6 show the handling of the sleeve of the first embodiment.
Figure 5:
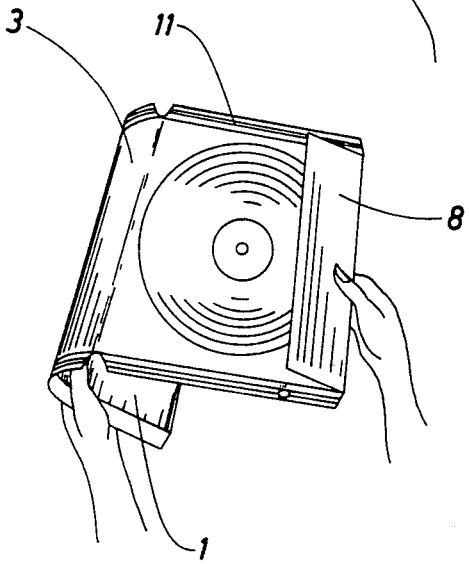
Figure 6:
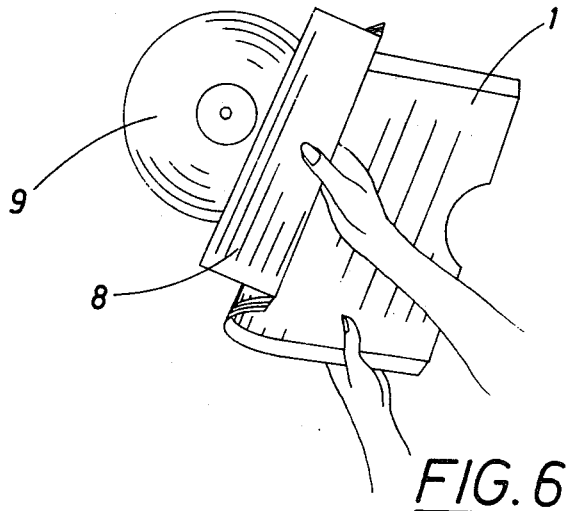
Figure 7:
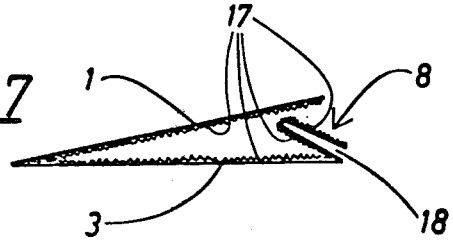
FIG. 7 is a cross sectional view in right angle to the cross sectional view in FIG. 2.

When the sleeve is opened in order to play the record it is not necessary to fold out the edge portions 11, it will be enough if the first section 1 is folded out and the section 3 bent in the folding line 6 placed under the edge section 8 whereby the edge portions 11 slide over the edges of the record and will thereby be opened. By the insertion of the record in the sleeve it is however necessary that the edge portions 11 in a certain operation are folded in after that the edge of the record has been grasped by means of the edge portion 8 and the opposite portion of the section 3 and before the pushing in of the section 1 under the edge portion 8. The handling will thus be a little more inconvenient than by the embodiments described before but on the other side no special locking elements are necessary for the sleeve but the same can be made entirely in paper material. An outer aluminum lining, preferably on the flap formed of the section 8 is thus in connection with remaining aluminum lining and thus with the aluminum lining directed against the record sides. As the sleeve will be grasped by the hand over the portion 8 as shown in FIGS. 4–6 the hand will be in conducting connection with the entire aluminum lining. As the aluminum lining of the sections 1, 3 will be in connection with the record sides when the record 9 is inserted in the sleeve all static electricity on the record sides will be conducted from the record by means of the hand via the unbroken aluminum lining. The folding of the flap forming the section 8 has naturally to be made in that way that the aluminum lining not will be broken.

Figure 8:
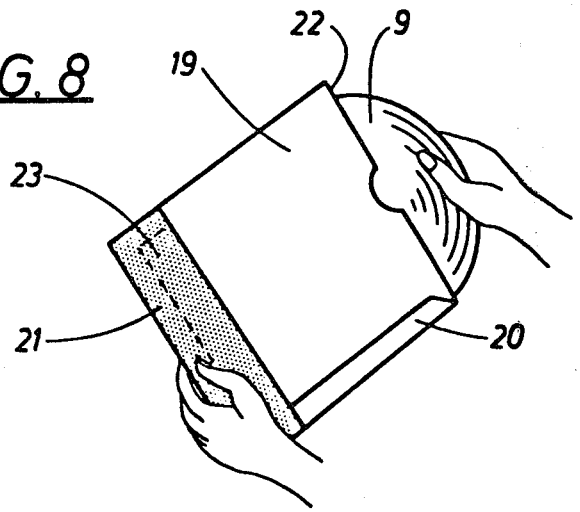
FIG. 8 shows the sleeve according to the second embodiment and its handling.
Figure 9:
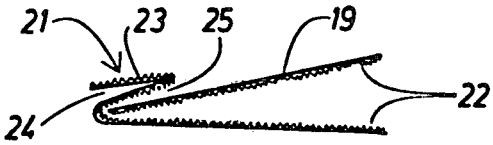
FIG. 9 shows the second embodiment in a cross sectional view corresponding to the cross sectional view in FIG. 7.

A record sleeve of conventional design of a baglike model is illustrated in FIGS. 8 and 9. The sleeve is formed by a double folded paper sheet 19, which along two edges is joined by a flap 21 and a flap 20. By this arrangement an open side 22 is formed, where the grammophone record 9 can be inserted into and extracted from the sleeve. The paper sheet 19 is aluminum lined, the aluminum side being turned inwards. However, the flap 21 is double folded as is shown in FIG. 9 and thereby an outer band 23 of the aluminum coating is formed. The band is in connection with the inner aluminum coating, and thus, the sides of the records can be grounded by the hand when the sleeve is grasped in the manner illustrated in FIG. 8. The points 24 and 25 at the flap 21 are glued points, which for clarity's sake have been folded upwards in the drawing.

As one can conclude from FIGS. 4–6 a grammophone record 9 when stored in the sleeve, is lying against the middle section 3, with the edge section 8 folded over the record. The first section 1 is finally folded down over the record and the edge section 8. However, in FIG. 4 the section 1 is shown halfways folded upwards. In this position the several sections of the paper sheet are forming a sleeve for the grammophone record, which sleeve can be locked along its edges by means of the chosen locking device according to FIGS. 3 or 10–14.

When the record is going to be played the thumb is placed in the cut 2, whereafter the edge portion of the section 1 is grasped with the other hand and fold it out from the record 9, as is shown in FIG. 4. By means of continuous unfolding of the first section 1 also the middle section 3 is folded out from the record, as shown in FIG. 5. In the final condition the hand holds around the record by means of a pinching grip over the edge section 8 and the edge portion of the middle section 3 positioned close to the folding line 7. The first section 1 and the main portion of the middle section 3 are, however, kept aside in a backwards folded condition, as is shown in FIG. 6 which is performed by means of the original finger grip around the edge of the first section 1 as shown in FIG. 4, Thus, the record is after the pulling out from the outer sleeve freed from the sleeve while retaining it in a single pinching grip round its edge without having to touch the very surface of the record. In the final grip illustrated in FIG. 5 the record can easily be laid on the turntable, the sleeve still accompanying the same. Most turntables are in fact somewhat smaller than the usually common longplaying records, and therefore the pinching grip illustrated in FIG. 6 permits the deposition of the record without difficulty. After placing the record on the turntable, the sleeve is pulled aside and the record can be played. In those cases where the turntable is just as big as the record, one must see to it that the pinching grip is formed by the thumb and the forefinger only, so that the record in an oblique position can be moved over the center pin of the turntable with the forefinger between the record and the turntable. Finally, one withdraws the hand together with the record sleeve and the record falls down on the turntable.

When the record is going to be removed from the turntable it is grasped by the edge with the record sleeve around the same using the same pinching grip as is illustrated in FIG. 6 keeping the first section 1 aside with the other hand and grasping over the edge of the record with the record sleeve in between by means of easing of the pinching pressure. The record is then removed and with the other hand the first section 1 is folded over. In connection with turntables of the bigger type one can, in connection with the removal of the record, turn the sleeve with the edge section 8 downwards and push in said section inwards between the record and the turntable, whereafter it is easy to remove the record. After the folding over of the section 1 the edges 10 are locked if they are provided with locking stripes 11.

The sleeve according to the second embodiment is handled in a conventional way according to what is shown if FIG. 8.

The sleeve according to the second embodiment is handled in a connection irrespective of which general design the sleeve is, the fundamental idea behind the invention is that the inner surface of the sleeve facing the sides of the record shall be provided with a conducting coating which is in leading connection with at least one outer conducting surface, which occupies such a position that it is grasped by the hand, when the sleeve is handled in connection with the insertion and the extraction of the record. As mentioned an aluminum lined paper is a suitable material for the sleeve, but also an aluminium coating printed on a paper can be imagined. Also a metallized plastics foil or a foil coated with a metal can be used as material. A conducting coating can also be obtained by means of carbon, which however, does not give the same rapid and complete discharging effect as a metal on account of the poorer conducting property of carbon.

A metal as aluminum is a good conductor and therefore yields the best result. However, aluminum foil cannot be used as it is easy to wrinkle. As a consequence thereof it gets a poor adhesion to the record an the wrinkled surface can easily scratch the sides of the record. However, so called aluminum lined paper, i.e. paper lined with a very thin aluminum foil is an excellent material. The paper maintains the foil in a straightened out condition without any sharp cockles appearing. The aluminum foil must have an uninterrupted continuation on the outside of the sleeve, so that it will give a contact with the hand, when the sleeve is handled.

A record sleeve made of aluminum lined paper as described has no tendency to attract dust. Dust, that possibly falls down on the surfaces of the sleeve, easily falls off or can be shaken away. Also in this respect the record sleeve shows advantageous differences from record sleeves of the prior art. Sleeves of paper or plastics of the hitherto common type have in itself a tendency to be electrically charged and accumulate dust, which is transferred to the record. There is also an additional risk that the sides of the sleeve get charged in connection with the extraction of the record from and its insertion into the sleeve. Also these drawbacks are eliminated by means of the sleeve described.

In order to investigate the effects of the record sleeve the following tests were made:

1. A grammophone record was charged with static electricity by playing it.

2. The record was brought into contact with a textile material, whereby great quantities of textile dust got deposited on the sides of the record.

3. The same procedure was repeated, but between the the playing operation and the contact with the textile material the record for a short interval was inserted into a record sleeve of plastics lined paper. Only an insignificant reduction of the tendency of dust accumulation could be noticed.

4. The procedure was repeated, but between the playing operation and the contact with the textile material the record for a short interval was inserted into a record sleeve of aluminum lined paper, the conducting aluminum layer of which was grounded by means of the hand. The record thereafter was completely discharged and proved to be almost entirely free from any tendency to collect dust.

By means of the test the excellent effect of the sleeve to reduce the tendency of grammophone records to collect dust is proved.

INDUSTRIAL APPLICABILITY

The record sleeve according to the invention suitably is used for the packing as well as storing of grammophone records.

I claim:

1. A grammophone record sleeve made of thin material, such as paper or cardboard, comprising: a first section, a second section connected to said first section along one edge thereof, said sections having such a substantially square shape and a size that they are adapted to substantially cover a record to be stored therebetween; said first section also having opposite, first edge portions perpendicular to said connecting edge; said second section having opposite, second edge portions essentially perpendicular to said connecting edge; and first and second locking means respectively provided at said first and second edge portions for connecting said sections, said locking means consisting of two stripes one running along one of said second edge portions of said first section and attached thereto and continuing along the corresponding edge portion of said second section and the other one running along the other of said second edge portion of said first section and attached thereto and continuing along the adjacent edge portion of said second section, said stripes being substantially unchanged in their crossection along their entire length and each carrying pairs of rims having widened portions at their free ends, said stripes being displaced so that the respective portions running along the edges of said first section are offset with respect to the respective portions running along the edge of said second section, so that one rim of each stripe located on said first section can be inserted and locked between the respective pair of rims of said second section and one of the respective rims of said second section can be inserted and locked between the pair of rims of said first section to thereby form a releasable connection between said sections.

2. A grammophone record sleeve according to claim 1, wherein the offset of said rims with respect to each other is formed by a corrugation in one of said sections.

3. A grammophone record sleeve according to claim 1 or 2, including an outer layer covering at least one of said sections.

4. A grammophone record sleeve according to claim 1, comprising a third section provided on the edge opposite said one edge on one of said first and second sections, said third section when receiving a record therein being in a position between said first and second sections, said third section having a limited extension from the edge where it is connected to said one section, so that it covers the grammophone record when placed therein only at an edge portion thereof, whereby the record when placing the same on a turntable can be grasped between said one section and said third section over a major portion thereof when folding out the record from the other section and the substantial part of the one section.

5. A grammophone record sleeve according to claim 4, wherein said three sections consist of one single substantially rectangular sheet of material folded along two lines forming said one and said other edge.

6. A grammophone record sleeve according to claim 5, wherein said other section is provided with a notch at its outer edge opposite said connecting edge whereby said third section is partly free when a record is placed in said sleeve.

7. A grammophone record sleeve according to claim 6, wherein said one section and said third section are connected to each other at opposite edges and at said folding line between said one and third sections so that a shallow pocket for the edge of the grammophone record is provided.

* * * * *